US007583235B2

(12) United States Patent
Kim et al.

(10) Patent No.: US 7,583,235 B2
(45) Date of Patent: Sep. 1, 2009

(54) FOLDED DIPOLE LOOP ANTENNA HAVING MATCHING CIRCUIT INTEGRALLY FORMED THEREIN

(75) Inventors: Yong-jin Kim, Yongin-si (KR); Wee-sang Park, Yongin-si (KR); Young-eil Kim, Yongin-si (KR); Yun-taek Im, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 3 days.

(21) Appl. No.: 11/700,049

(22) Filed: Jan. 31, 2007

(65) Prior Publication Data

US 2008/0122710 A1 May 29, 2008

(30) Foreign Application Priority Data

Sep. 12, 2006 (KR) ..... 10-2006-0088238

(51) Int. Cl.
*H01Q 9/26* (2006.01)

(52) U.S. Cl. ..... 343/803; 343/860

(58) Field of Classification Search ..... 343/742, 343/726, 700 MS, 867, 741, 866, 727, 728, 343/803, 850, 860

See application file for complete search history.

(56) References Cited

U.S. PATENT DOCUMENTS

| | | | | |
|---|---|---|---|---|
| 5,198,826 | A * | 3/1993 | Ito | 343/726 |
| 5,568,156 | A * | 10/1996 | Terashima et al. | 343/713 |
| 6,590,542 | B1 * | 7/2003 | Briggs | 343/742 |
| 2003/0119677 | A1 * | 6/2003 | Qiyan et al. | 505/210 |
| 2005/0190112 | A1 * | 9/2005 | Thudor et al. | 343/767 |
| 2006/0055617 | A1 * | 3/2006 | Hall | 343/850 |
| 2006/0132364 | A1 * | 6/2006 | Qi et al. | 343/702 |

FOREIGN PATENT DOCUMENTS

KR 10-2006-0040312 A 5/2006

* cited by examiner

*Primary Examiner*—Hoang V Nguyen
(74) *Attorney, Agent, or Firm*—Sughrue Mion, PLLC

(57) ABSTRACT

A folded dipole loop antenna has a matching circuit integrally formed therein. The antenna includes a radiating unit formed in the shape of a loop, and the matching circuit has an extended part projected and extended toward a central area of the radiating unit from an inner side surface of the radiating unit, thereby eliminating the need for a separate space for the matching circuit. The antenna can change a resonant frequency thereof by adjusting input reactance through the matching circuit.

8 Claims, 10 Drawing Sheets

FOLDED DIPOLE LOOP ANTENNA HAVING MATCHING CIRCUIT INTEGRALLY FORMED THEREIN

CROSS-REFERENCE TO RELATED APPLICATIONS

This application claims the benefit under 35 U.S.C. § 119 (a) of Korean Patent Application No. 10-2006-0088238, filed Sep. 12, 2006, in the Korean Intellectual Property Office, the entire disclosure of which is incorporated herein by reference.

FIELD OF THE INVENTION

The present invention relates generally to a folded dipole loop antenna having a matching circuit integrally formed therein. More particularly, the present invention relates to a folded dipole loop antenna, which has a matching circuit integrally formed therein to adjust an input reactance thereof and an input impedance thereof and to reduce the size of a device to which it is mounted.

BACKGROUND OF THE INVENTION

Generally, a loop antenna is formed in the shape of a tetragonal loop, a circle loop, or the like and is used in various fields according to a length thereof.

The loop antenna has a characteristically low input resistance. In order to match a 50Ω input resistance of a general antenna, the length of the loop antenna should be taken into account in its design.

According to an impedance curve of a square-shaped loop antenna, an input resistance comes close to 50Ω and an input reactance comes close to 0 only when the length of the loop is near to one wavelength. That is, the loop antenna causes resonances only when it is designed to have the length of one wavelength.

Also, the loop antenna has a radiating pattern which changes according to the length thereof. For instance, the loop antenna radiates electromagnetic waves along a plane direction thereof when the length of the loop antenna is shorter than one wavelength, and along a direction vertical to the plane direction thereof when it is longer than one wavelength. Accordingly, the radiating pattern of the loop antenna can be adjusted by adjusting of the length of the loop antenna.

However, if the radiating pattern is adjusted by forming the length of the loop antenna to be shorter or longer than one wavelength as described above, it is difficult to match the input resistance and the input reactance due to characteristics of the loop antenna. Accordingly, a device to which the antenna is mounted should be equipped with a separate matching circuit for matching the input resistance and the input reactance.

However, if the device is equipped with the separate matching circuit, it requires a space for installing the matching circuit. Also, there is a disadvantage in that if a design of the matching circuit should be changed due to interference with other circuit elements after the matching circuit is mounted to the device, it is not easy to change the design of the matching circuit.

Thus, there is required a new method capable of minimizing the space which the matching circuit occupies thereby reducing the device in size, and easily changing the design of the matching circuit.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

ms According to an aspect of the present invention, there is provided a folded dipole loop antenna in which a matching circuit is integrally formed to adjust a change of an input reactance thereof and thus to change a resonant frequency thereof, as well as to reduce a size of a device to which the antenna is mounted.

According to another aspect of the present invention, there is provided a folded dipole loop antenna including a matching circuit integrally formed in the antenna, and a radiating unit formed in the shape of a loop. The matching circuit has an extended part projected and extended toward a central area of the radiating unit from an inner side surface of the radiating unit.

The radiating unit may include an inner loop and an outer loop, which are formed in the same shape.

The outer loop at one side thereof may be opened to have both ends, one of which forms a current supplying point and the other of which forms a shorting point.

The inner loop may be formed to be bent toward an inner side of the outer loop at an area thereof opposite to the current supplying point and the shorting point of the outer loop and then extended along an inner side surface of the outer loop.

The extended part may include a pair of extended lines disposed to face each other toward a central area of the inner loop, free ends of the extended lines being disposed in a spaced-apart relation to each other.

The extended lines may be formed on the same line.

A tuning part may be formed on each of free ends of the extended lines to be enlarged by a predetermined length in a direction vertical to a longitudinal direction thereof.

The more a length of the tuning part is reduced, the more a resonant frequency may be lowered.

The above and other aspects of the invention will become apparent to those skilled in the art from the following detailed description, which, taken in conjunction with the annexed drawings, discloses exemplary embodiment of the invention.

BRIEF DESCRIPTION OF THE DRAWINGS

The above aspect and other features of the present invention will become more apparent by describing in detail exemplary embodiment thereof with reference to the attached drawing figures, wherein.

Throughout the drawings, the same drawing reference numerals will be understood to refer to the same elements, features, and structures.

DETAILED DESCRIPTION OF THE EXEMPLARY EMBODIMENTS

Hereinafter, a folded dipole loop antenna according to an exemplary embodiment of the present invention will be described in greater detail with reference to the accompanying drawings.

Figure 1:
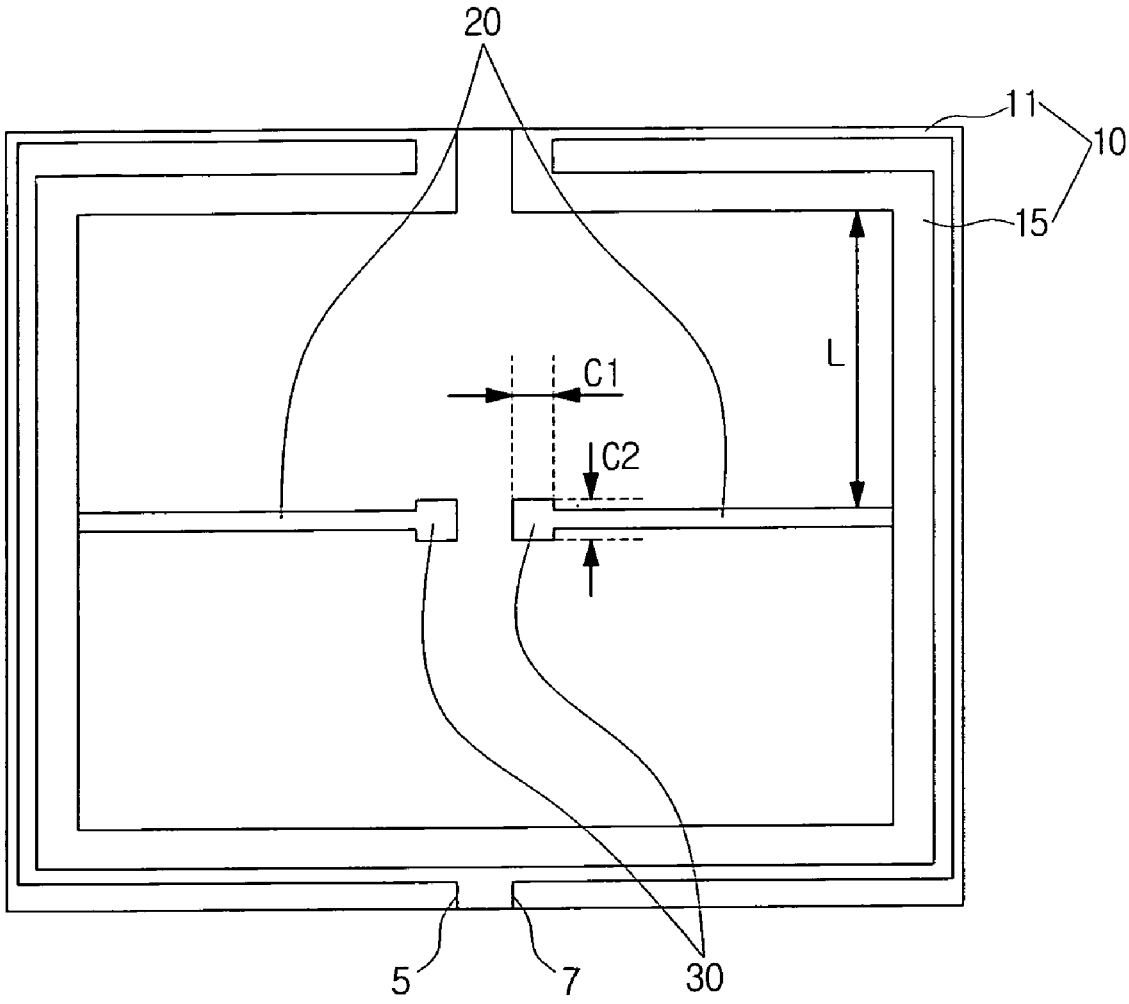
FIG. 1 is a top plan view illustrating a folded dipole loop antenna according to an exemplary embodiment of the present invention.

FIG. 1 is a top plan view exemplifying a folded dipole loop antenna according to an exemplary embodiment of the present invention.

The folded dipole loop antenna according to an exemplary embodiment of the present invention includes a radiating unit 10 to radiate electromagnetic waves, and a matching circuit 20 and 30 to adjust an input reactance of the loop antenna, and is mounted to a circuit board or the like in a spaced-apart relation therewith.

The radiating unit 10 is formed in the shape of a tetragonal loop, a circle loop, etc. FIG. 1 illustrates a radiating unit 10 formed in the shape of the tetragonal loop as an example.

The radiating unit 10 includes an inner loop 15 and an outer loop 11, which are formed of a single conductive wire or strip line bent several times. The outer loop 11 is opened at one side having both ends 5, 7 bent facing the circuit board (not illustrated).

The both ends of the outer loop 11 are connected with a resonating unit (not illustrated) installed in the circuit board, so that one end of the outer loop forms a current supplying point 5 and the other end of the outer loop forms a shorting point 7. The current supplying point 5 receives an electric current from the resonating unit (not illustrated), and the shorting point 7 provides an electric current, which remains in the radiating unit 10, to the resonating unit. The inner loop 15 is formed of a conductive wire or a strip line, which is bent toward an inner side of the outer loop 11 from one side portion of the outer loop 11 opposite to the current supplying point 5 and the shorting point 7 and then extended and disposed in the form of a loop spaced apart from the outer loop 11 along an inner side surface of the outer loop 11. The inner loop 15 is formed in the same shape as that of the outer loop 11.

The radiating unit 10 constructed as described above constitutes a folded dipole antenna having the same loop shape as that formed by bending a conventional dipole antenna several times.

In the radiating unit 10 is disposed the matching circuit 20 and 30.

The matching circuit 20 and 30 includes an extended part 20 extended from an inner side surface of the inner loop 15 of the radiating unit 10, and a tuning part 30 formed on free ends of the extended part 20.

The extended part 20 is formed of a pair of extended lines extended toward a central area of the radiating unit 10 from the inner side surface of the inner loop 15. To be more specific, the extended lines are extended from a pair of sides of the inner loop 15, which are located adjacent to a side of the outer loop 11 on which the current supplying point 5 and the shorting point are formed and a side on which the outer loop 11 and the inner loop 15 are connected with each other, respectively. The extended lines are formed on the same line, and free ends of the extended lines are disposed in a spaced-apart relation to each other.

The tuning part 30 is formed of a pair of tuning lines, each of which is formed on one of the free ends of the extended lines. Each of the tuning lines are enlarged and formed by predetermined length and width along a longitudinal direction of the corresponding extended line. Such a tuning part 30 is formed in the form of a capacitor, and acts as the matching circuit 20 and 30 together with the extended part 20.

Figure 2A:
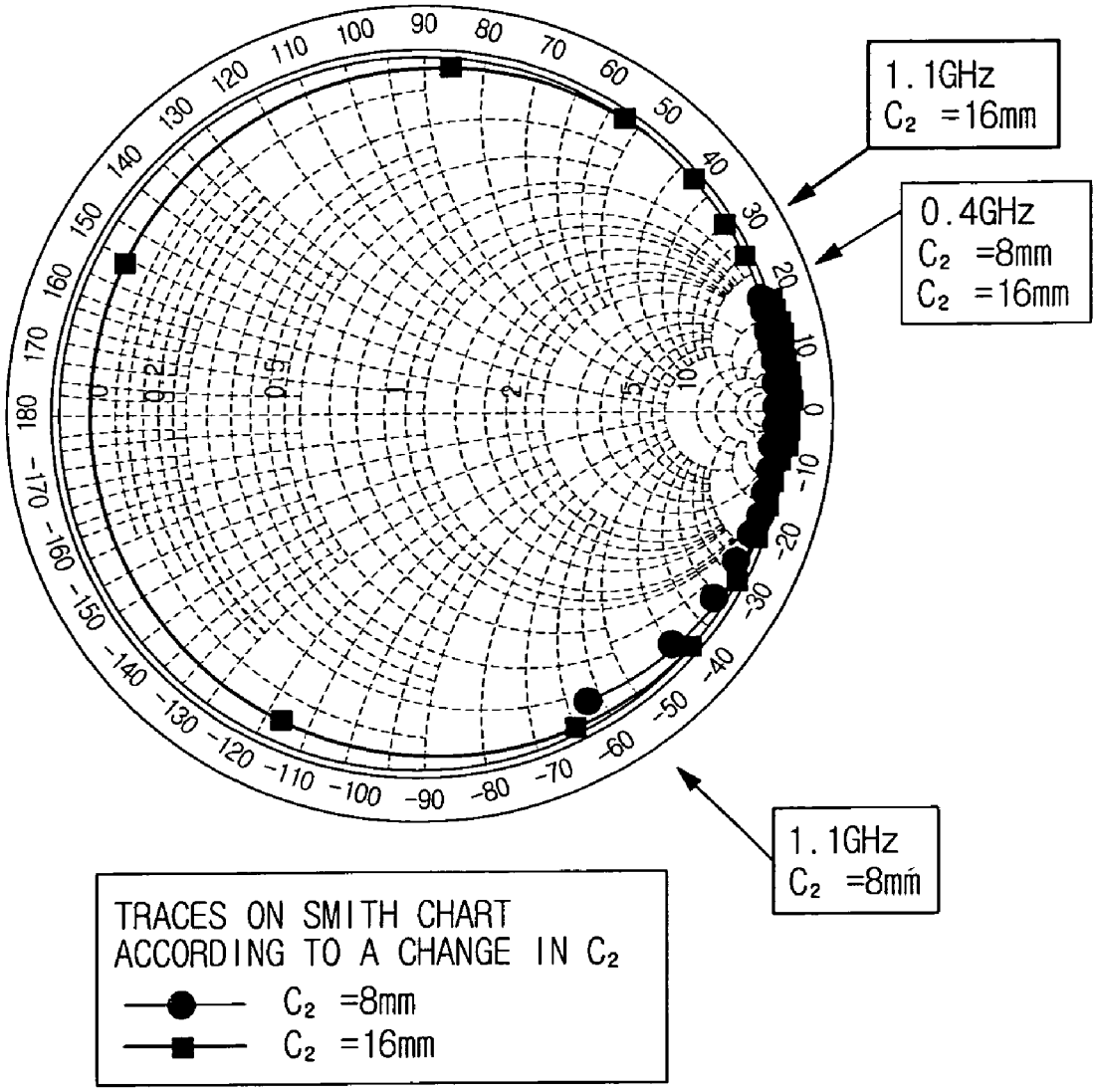
FIG. 2A is a view illustrating traces on a Smith chart, which changes according to a length $C_2$ of a tuning part of FIG. 1.
Figure 2B:
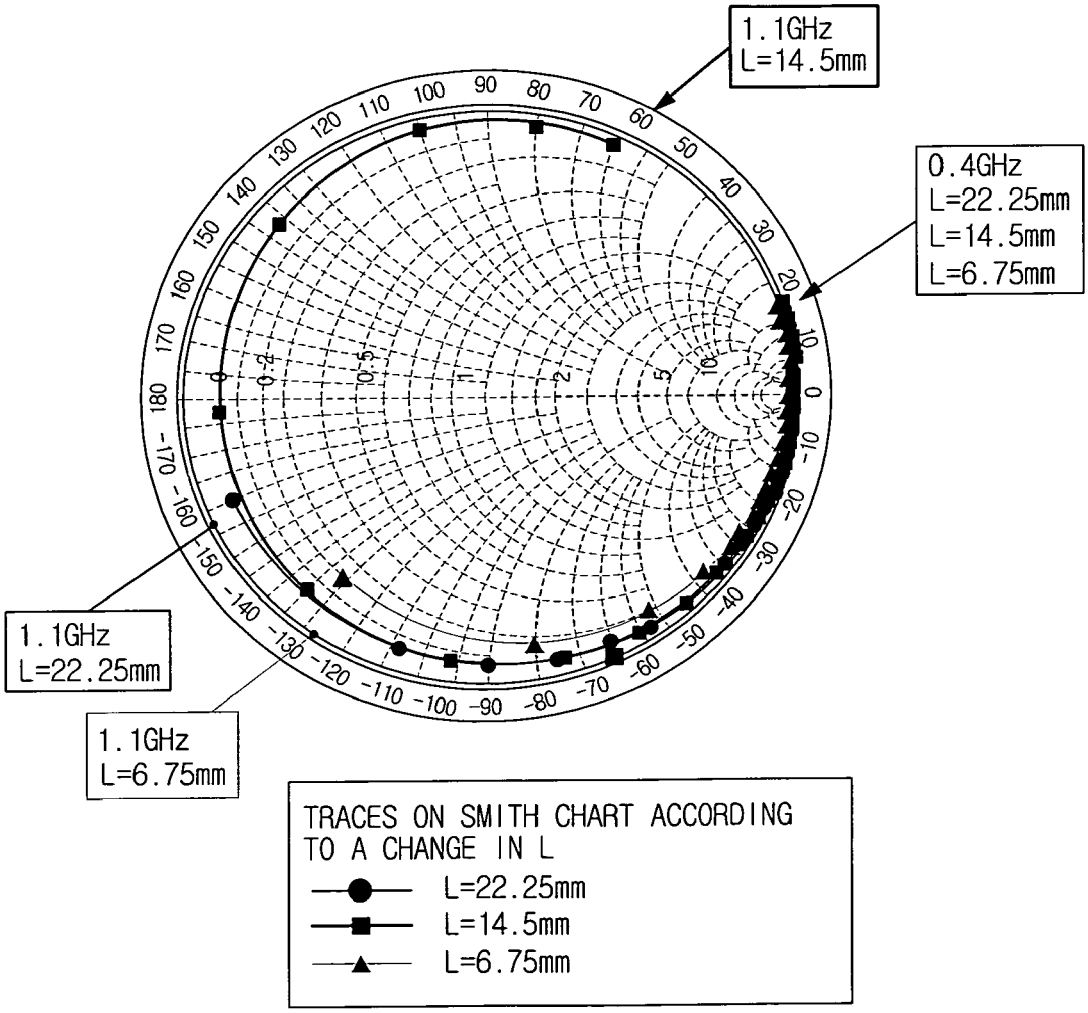
FIG. 2B is a view illustrating traces on the Smith chart, which changes according to a distance L between an extended part and an inner loop of FIG. 1.

FIG. 2A is a view illustrating traces on a Smith chart, which change according to a length $C_2$ of the tuning part 30 of FIG. 1, and FIG. 2B is a view illustrating traces on the Smith chart, which change according to a distance L between the extended part 20 and the inner loop 15 of FIG. 1.

As illustrated in FIG. 2A, as the length $C_2$ of the tuning part 30 is adjusted, the trace on the Smith chart is changed. That is, it can be seen that when traces on the Smith chart are measured after adjusting the length $C_2$ from 8 mm to 16 mm, with the distance L fixed, the greater the length of $C_2$, the more a change width of the trace on the Smith chart is enlarged. The reason is that in a reactance curve of the antenna, the more a capacitance of the capacitor is decreased, the more a resonant frequency is lowered.

On the other hand, as illustrated in FIG, 2B, it can be appreciated that when the distance L is adjusted with the length $C_2$ is fixed, there is almost no change between resultant traces on the smith chart. This means that what is important is not positions of the extended part 20 and the tuning part 30 in the loop, but the existence of the extended part 20 and the tuning part 30 disposed in the loop and the value of C2.

Figure 3A:
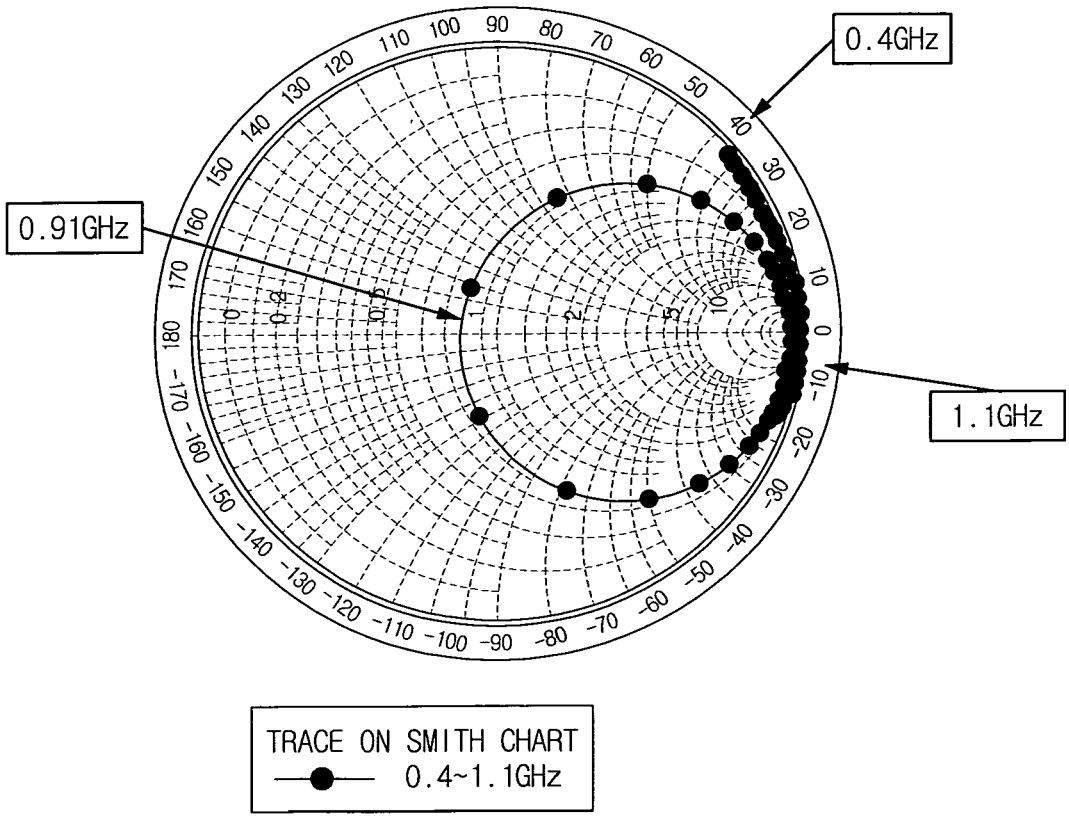
FIG. 3A is a view illustrating a trace on the Smith chart in case that a matching circuit is removed from the folded dipole loop antenna of FIG. 1.
Figure 3B:
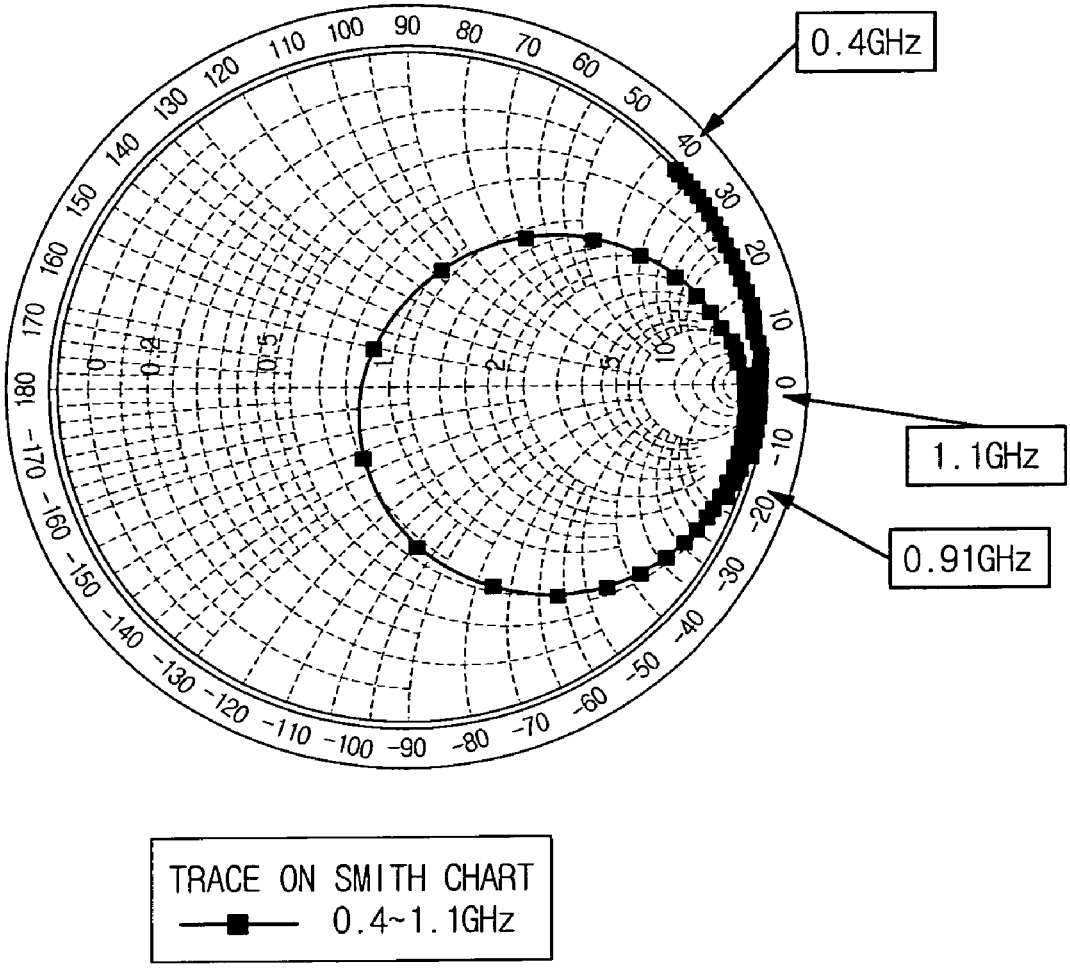
FIG. 3B is a view illustrating a trace on the Smith chart of the folded dipole loop antenna of FIG. 1.

FIG. 3A is a view illustrating a trace on the Smith chart in the case that the matching circuit 20 and 30 is removed from the folded dipole loop antenna of FIG. 1, and FIG. 3B is a view illustrating a trace on the Smith chart of the folded dipole loop antenna of FIG. 1.

The traces on the Smith chart shown in FIGS. 3A and 3B have almost the same shape. This means that irrespective of whether the matching circuit 20 and 30 exists, there is no change in a resistance value of the folded dipole loop antenna.

However, comparing FIG. 3A in case that the matching circuit 20 and 30 does not exist and FIG. 3B in case that the matching circuit 20 and 30 exists, it can be appreciated that resonant frequencies are different. That is, the resonant frequency of the antenna having the matching circuit 20 and 30 is lower than that of the antenna not having the matching circuit 20 and 30. The reason is that in the case of having the matching circuit 20 and 30, the matching circuit 20 and 30 abruptly changes an input reactance in the antenna and thus lowers the resonant frequency.

Figure 4:
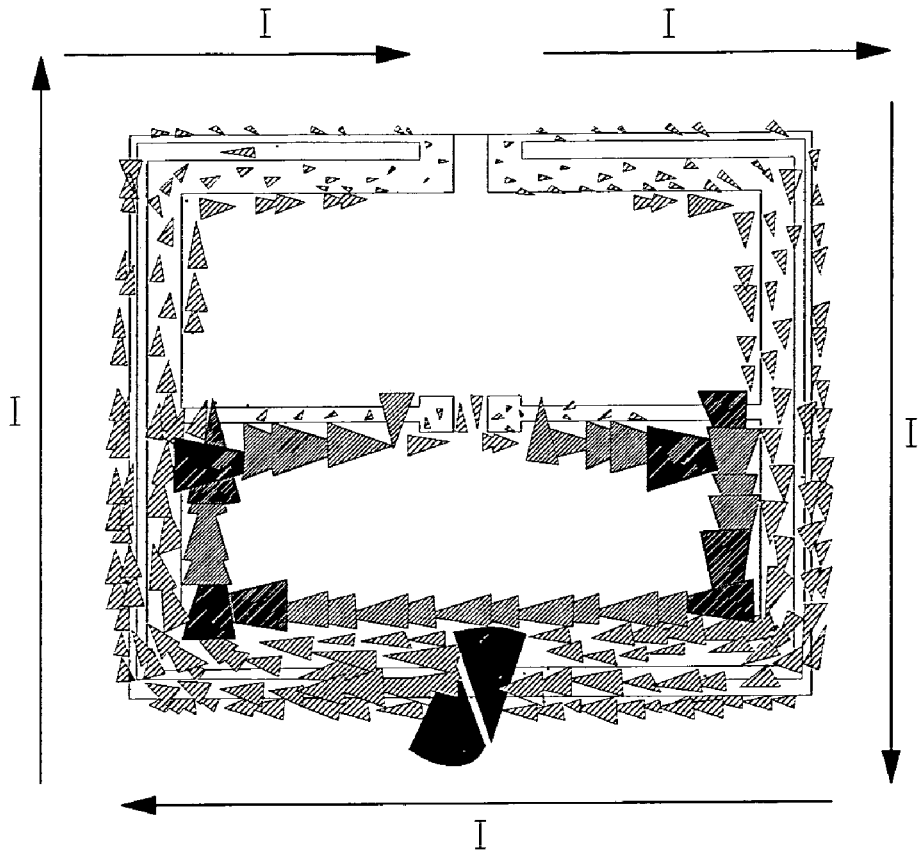
FIG. 4 is a view illustrating a flow of electric current of the folded dipole loop antenna of FIG. 1.

FIG. 4 illustrates a flow of electric current of the folded dipole loop antenna of FIG. 1.

As illustrated in the drawing, the folded dipole loop antenna according to the exemplary embodiment of the present invention has an electric current path divided into two parts by the matching circuit 20 and 30. One part of the electric current path is a main current path flowing along the inner loop 15 and the outer loop 11, and the other part of the electric current path is a subsidiary current path flowing along the extended lines and the tuning lines. Since the inner loop 15 and the outer loop 11 have the same shape as that formed by bending the conventional dipole antenna several times, similar to the antenna mode of the dipole antenna, they have a main current flow along the longitudinal direction of the dipole antenna, that is, a girth direction of the inner loop 15 and the outer loop 11. The matching circuit 20 and 30 has a subsidiary current flow from one extended line adjacent to the current supplying point 5 to the other extended line adjacent to the shorting point 7. Here, the subsidiary current acts as a feedback.

An amount of current flowing along the main current path is adjusted by an amount of feedback current flowing along the subsidiary current path. This means that the amount of current flowing along the main current path is adjusted according to the length of the tuning part 30. Due to the adjustment of the amount of current and the change in phase as described above, the input reactance can be adjusted.

Figure 5:
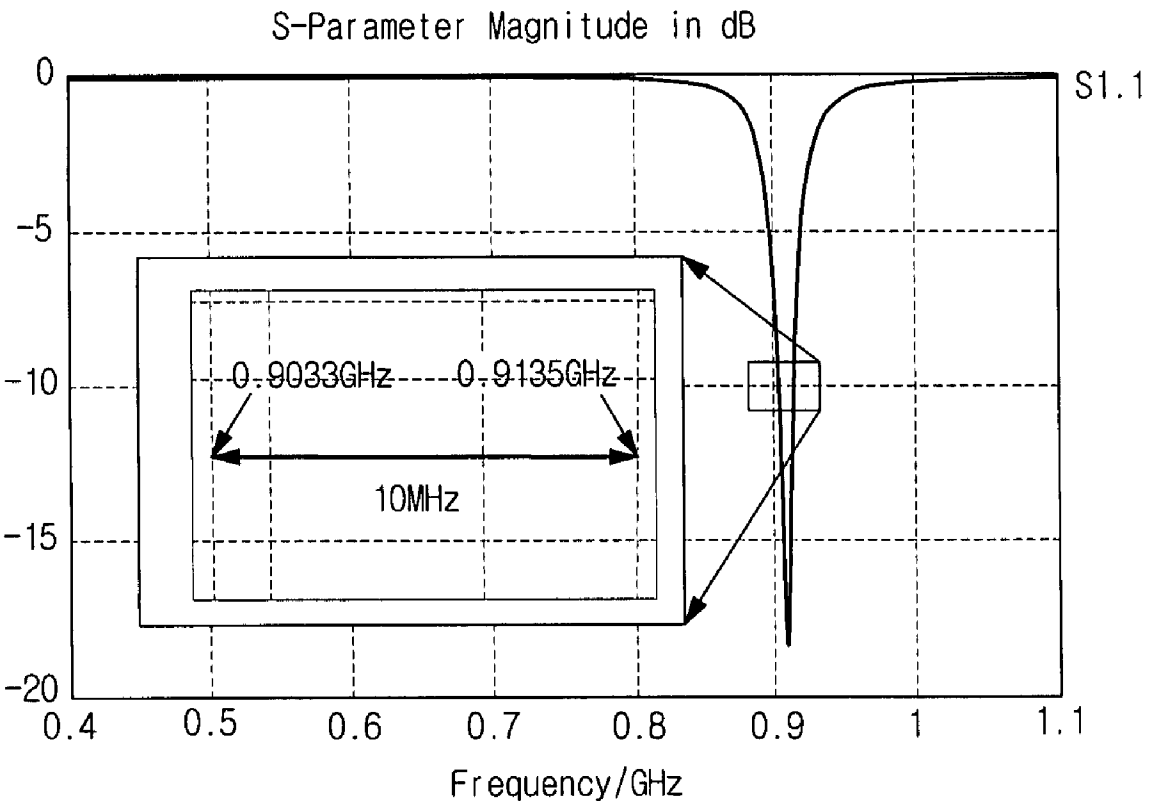
FIG. 5 is a graph illustrating an S11 characteristic of an example of the folded dipole loop antenna according to the exemplary embodiment of the present invention.

FIG. 5 is a graph illustrating an S11 characteristic of the folded dipole loop antenna according to the exemplary embodiment of the present invention.

FIG. 5 illustrates an S11 characteristic of an example of the folded dipole loop antenna according to the exemplary embodiment of the present invention in which lengths of the radiating unit 10, the extended part 20, and the tuning part 30 are designed in predetermined values. As illustrated in the graph, the folded dipole loop antenna according to the exemplary embodiment of the present invention forms a resonant frequency at a band of approximately 0.91 GHz. A bandwidth at −10 dB is approximately 10 MHz from 0.9035 GHz through 0.9135 GHz. That is, the folded dipole loop antenna according to the exemplary embodiment of the present invention is usable as an antenna at the band as described above, and particularly, is adapted to use as an antenna of a radio frequency identification (RFID) system.

Figure 6A:
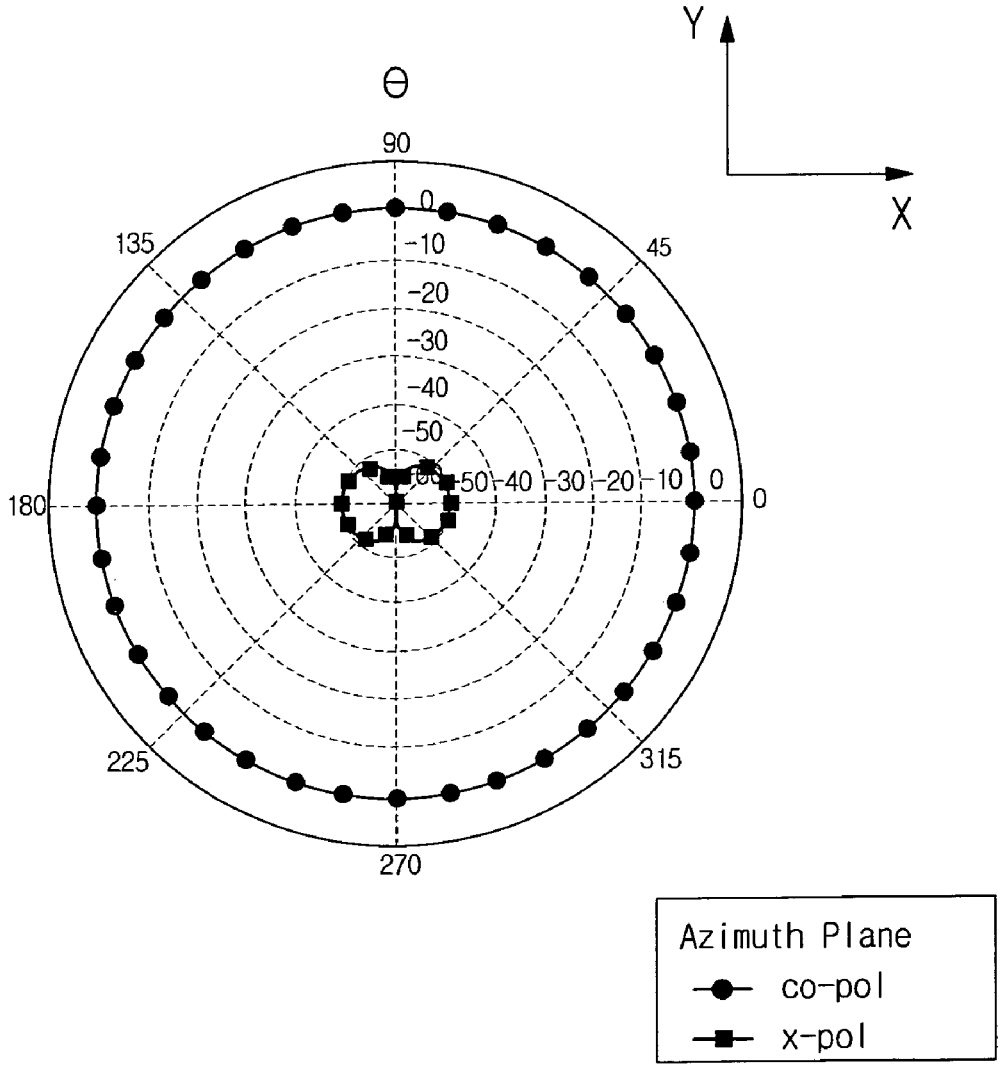
FIGS. 6A through 6C are graphs illustrating a radiating characteristic of the folded dipole loop antenna of FIG. 1.
Figure 6B:
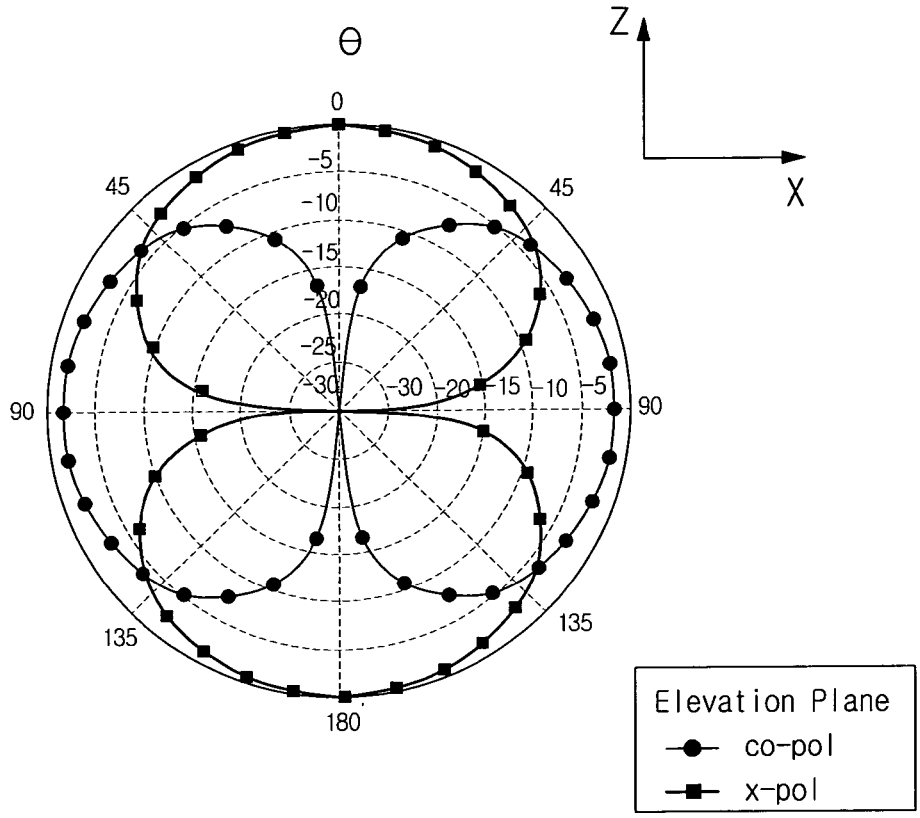
Figure 6C:
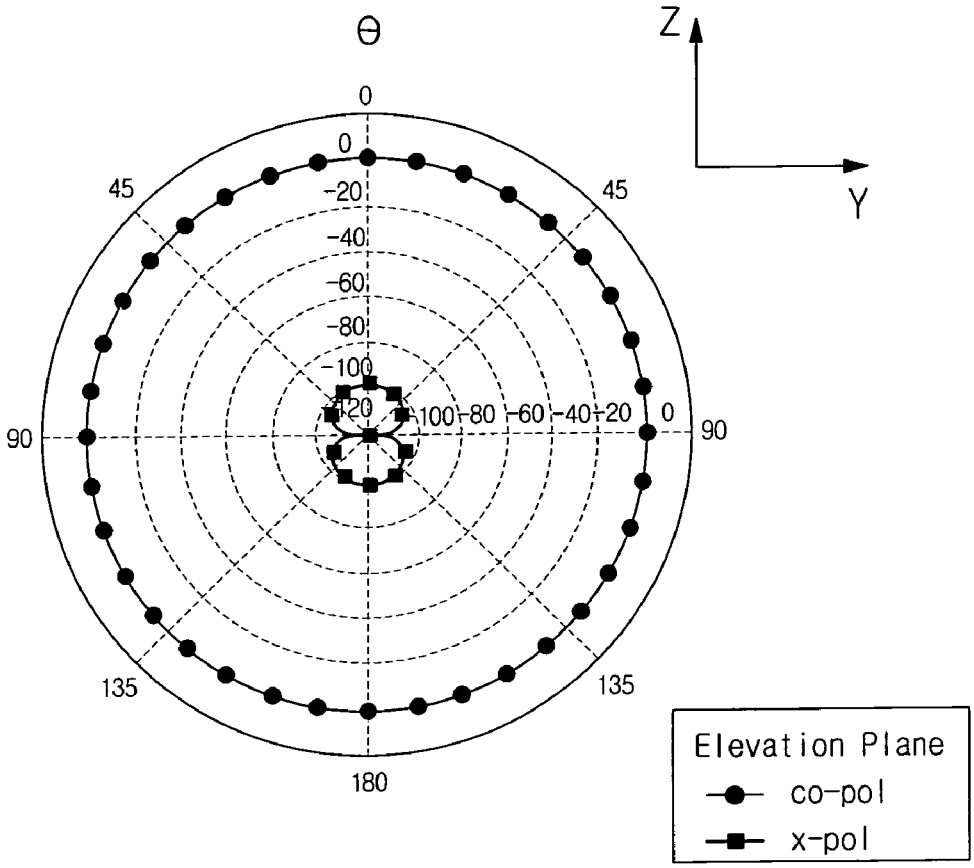

FIGS. 6A through 6C are graphs illustrating a radiating characteristic of the folded dipole loop antenna of FIG. 1.

Assuming that a longitudinal direction of the extended part 20 in a plane of the folded dipole loop antenna is an X axis, a longitudinal direction ($C_2$ direction) of the tuning part 30 in the plane of the folded dipole loop antenna is a Y axis, and a direction normal to the plane of the folded dipole loop antenna is a Z axis, FIG. 6A represents a radiating pattern as viewed from the X-Y axes, FIG. 6B represents a radiating pattern as viewed from the Z-X axes, and FIG. 6C represents a radiating pattern as viewed from the Z-Y axes.

Referring to the graphs of FIGS. 6A through 6C, the folded dipole loop antenna has omnidirectional properties at the respective planes. From this, it can be appreciated that the matching circuit 20 and 30 formed in the loop antenna does not influence the radiating patterns of the loop antenna.

As is apparent from the foregoing description, according to the exemplary embodiment of the present invention, the folded dipole loop antenna has the matching circuit integrally formed therein. Accordingly, a device to which the loop antenna is mounted does not need a separate space for the matching circuit, so that it can be reduced in size. Also, the folded dipole loop antenna can change the resonant frequency by adjusting the change of the input reactance through simply adjusting the length of the tuning part. Accordingly, the folded dipole loop antenna can conveniently change a design of the matching circuit.

Although an exemplary embodiment of the present invention has been shown and described in order to exemplify the principle of the present invention, the present invention is not limited to the specific exemplary embodiment. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A folded dipole loop antenna, comprising:

a matching circuit integrally formed in the antenna; and a radiating unit formed in the shape of a loop, wherein the matching circuit has an extended part projected and extended toward a central area of the radiating unit from an inner side surface of the radiating unit.

2. The antenna of claim 1, wherein the radiating unit comprises an inner loop and an outer loop, which are formed in the same shape.

3. The antenna of claim 2, wherein the outer loop at one side thereof is opened to have a first end and a second end, wherein the first end forms a current supplying point and the second end forms a shorting point.

4. The antenna of claim 3, wherein the inner loop is bent toward an inner side of the outer loop at an area thereof opposite to the current supplying point and the shorting point and then extended along an inner side surface of the outer loop.

5. The antenna of claim 4, wherein the extended part comprises a pair of extended lines disposed to face each other toward the central area of the inner loop, and free ends of the extended lines are disposed in a spaced-apart relation to each other.

6. The antenna of claim 5, wherein the extended lines are formed along an imaginary center line extending lengthwise along the extended lines.

7. The antenna of claim 6, wherein a tuning part is formed on each of free ends of the extended lines to be enlarged by a specified length in a direction perpendicular to a longitudinal direction thereof.

8. The antenna of claim 6, wherein a resonant frequency decreases as a length of the tuning part is reduced.

* * * * *